United States Patent [19]

Usui

[11] Patent Number: 4,996,962

[45] Date of Patent: Mar. 5, 1991

[54] FUEL DELIVERY RAIL ASSEMBLY

[75] Inventor: Masayoshi Usui, Numazu, Japan

[73] Assignee: Usui Kokusai Sangyo Kaisha Ltd., Shizuoka, Japan

[21] Appl. No.: 454,989

[22] Filed: Dec. 22, 1989

[30] Foreign Application Priority Data

Dec. 28, 1988 [JP] Japan ..... 63-168204[U]

[51] Int. Cl.[5] ..... F02M 39/00

[52] U.S. Cl. ..... 123/456; 123/468; 123/470

[58] Field of Search ..... 123/456, 468–472; 137/561 A; 138/108; 239/600; 285/130, 173, 174, 238, 239

[56] References Cited

U.S. PATENT DOCUMENTS 4,913,119 4/1990 Usui ..... 123/456

FOREIGN PATENT DOCUMENTS 61-249738 11/1986 Japan .

62-152073 9/1987 Japan .

*Primary Examiner*—Tony M. Argenbright

*Attorney, Agent, or Firm*—Wenderoth, Lind & Ponack

[57] ABSTRACT

A fuel delivery rail assembly for supplying fuel to a plurality of fuel injectors in an engine is provided. The assembly comprises a plurality of sockets and a plurality of rail tubes made from heat shrinkable plastic materials extending from the sockets. Each of the sockets includes a tubular body and a pair of extension pipes extending outwardly from the body toward opposite directions. Interior surfaces of the tubular body are so formed as to receive a fuel injector. At least one end of each rail tube is overlapped above the extension pipe with a seal member therebetween and fixed thereon after being heated to a predetermined temperature.

2 Claims, 2 Drawing Sheets

FUEL DELIVERY RAIL ASSEMBLY

BACKGROUND OF THE INVENTION

This invention relates to a fuel delivery rail assembly for an internal combustion engine, especially for an automotive engine, equipped with a fuel injection system. The fuel delivery rail assembly delivers pressurized fuel supplied from a fuel pump toward intake passages or chambers via associated fuel injectors. The assembly is used to simplify installation of the fuel injectors and the fuel supply passages on the engine.

An example of an automotive engine cylinder head equipped with a fuel injector is shown in FIG. 4 of the attached drawings. In this cylinder head, toward inside of an intake manifold 52 leading to a cylinder 51, pressurized fuel is discharged from a fuel injector 55. The fuel delivery rail assembly 60, which concerns a substantial matter of the present invention, is only partially shown as a section of a socket 61. In this type of fuel delivery rail assembly, the injector 55 is accommodated within the socket 61 and fixed thereto by a cap having an electrical terminal. Between the injector 55 and the socket 61, two O-rings 58 and 59 are located in order to keep fluid tight seals therebetween.

A complete form of the fuel delivery rail assembly 60 is shown in FIG. 5. In this assembly 60, three tubular sockets 61 are interconnected by connecting pipes 62. Each of the sockets 61 is located at a predetermined distance from each other. These metallic sockets 61 are initially made through a forging process, and then directed to a precise machining work. In this step, especially interior surfaces of the socket should be smoothly finished in order to establish a fluid tight seal of O-ring. For this purpose, a special machining process of burnishing work is commonly utilized to effect a high grade of circumferential accuracy as well as surface smoothness.

Each socket 61 comprises a tubular body 63 having a top opening, a bottom opening and two lateral openings facing opposite directions. These lateral openings are used to receive distal ends of the connecting pipes. By means of brazing connections 64, the sockets 61 and the pipes 62 are fixed together. On upper flange of the tubular body 63 of the socket 61, a pair of extensions 65 having threaded holes are provided so as to receive the cap and to be bolted together.

Since the conventional fuel delivery rail assembly is constructed as stated above, many kinds of workings are necessary for manufacturing of the assembly. In particular, the brazing connections 64 give rise to manufacturing difficulties. During a connecting process of the socket 61 to the pipe 62, initially a provisional spot welding is applied to a parting line between them. And then, they are brazed together within a furnace. However, the parting line is defined between two kinds of saddle shapes, so that random gaps remain along the circumference of the parting line. As a result, the prior assembly have several drawbacks, such as fuel leakage and breakdown from the parting line.

Another disadvantage in prior art is that the above random gaps cause a misalignment between the socket and the injector. This kind of misalignment causes fuel leakage, a failure of fuel injection or breakdown of engine parts. This misalignment should be found out in examination process for the assembly.

Under the situation, for manufacturing of the prior fuel delivery rail assembly, many kinds of time-consuming working steps and examination process are needed, resulting in an increase of manufacturing cost.

SUMMARY OF THE INVENTION

It is an object of the present invention to overcome the above disadvantages in producing the fuel delivery rail assembly and to reduce the number of working steps.

Another object of the present invention is to overcome alignment problems in mounting of the fuel delivery rail assembly to an engine.

A further object of the present invention is to provide a lightweight fuel delivery rail assembly so as to reduce a resultant weight of an automotive engine.

Still further object of the present invention is to damp a generation of noise caused by a vibration of the fuel delivery rail assembly.

According to the invention, there is provided a fuel delivery rail assembly for an internal combustion engine comprising; a plurality of sockets, and a plurality of rail tubes made from heat shrinkable plastic materials extending from said sockets, each of said sockets having a tubular body and a pair of extension pipes extending outwardly from the body toward opposite directions, interior surfaces of said tubular body being so formed as to receive a fuel injector, at least one end of each rail tube being overlapped above said extension pipe with a seal member therebetween, each overlapped portion of said rail tubes being fixed on the extension pipe after being heated to a predetermined temperature.

Within the scope of the invention, the rail tubes are made from heat shrinkable plastic materials, so that they are fixed on the respective extension pipes through a heating step. Thus, the brazing connections are eliminated, whereby the assembling steps are considerably simplified. Since the overlapping connections between the sockets and the plastic rail tubes provide flexible engagements, there is no need of strict limitation about a dimensional accuracy or geometrical orientation of the parts. The rail tube is made from lightweight plastic materials, so that its weight becomes relatively lighter than that of the conventional metallic pipe. Thus, it can help to reduce the resultant weight of the fuel delivery rail assembly, thereby facilitating a reduction of the engine weight.

As a further advantage of the present invention, it can provide a practical solution to the alignment problem between the socket and the injector, since there remains a flexibility for the axial direction of the socket based upon the flexibility of the plastic tubes. This flexibility can also help to damp a vibration of the fuel delivery rail assembly. As a result, generation of noise is reduced.

Heat shrinkable plastic materials are well known in the art. They are utilized in wrapping process for covering miscellaneous goods. In a preferable embodiment of the invention, the rail tubes are made from crosslinked polyolefin plastics having heat resistant properties. Alternatively, heat resistant fluoroplastic tubes may be used for the same purpose.

Other features and advantages of the invention will become apparent from a reading of the specification, when taken in conjunction with the drawings, in which, like reference numerals refer to like elements in the several views.

DESCRIPTION OF THE PREFERRED EMBODIMENT

Figure 1:
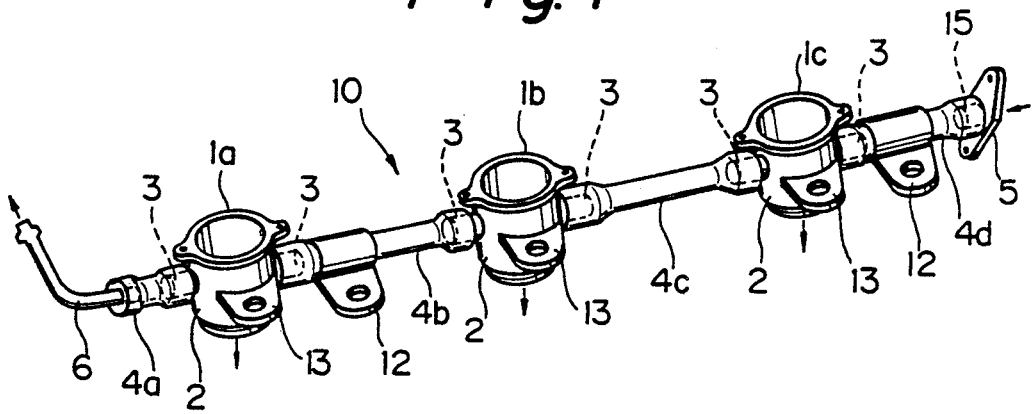
FIG. 1 is a perspective view of the fuel delivery rail assembly according to the invention.

Referring to FIG. 1, there is shown a fuel delivery rail assembly 10, a preferable embodiment of the present invention, which is adapted to three cylinders on one side of an automotive V-6 engine. This assembly 10 comprises three sockets 1*a*, 1*b* and 1*c* made by metallic materials, an outlet rail tube 4*a*, a first intermediate rail tube 4*b*, a second intermediate rail tube 4*c*, and an inlet rail tube 4*d*. Every rail tubes are made from heat shrinkable plastic materials, for example, crosslinked polyolefin plastics having superior properties of heat-resistance and fuel-resistance. Each socket is located at a predetermined distance from each other. To an outer end of the inlet rail tube 4*d*, an inlet flange 5 is fixed so as to combine with a pressure regulator or any other part leading to a fuel pressurizing pump, and to an outer end of the outlet rail tube 4*a*, a joint pipe 6 is fixed so as to receive a rubber hose. All of these parts are connected to keep fluid communication therethrough. In this assembly, gasoline fuel is supplied from the fuel pressurizing pump to a fuel passage arranged within the flange 5 leading to the inlet rail tube 4*d*. Most of the fuel supplied to the rail tubes 4*a*, 4*b*, 4*c* and 4*d* is discharged through the sockets 1*a*, 1*b* and 1*c* toward respective fuel injectors, and remaining fuel is carried through the joint pipe 6 to another fuel delivery rail assembly on the other side of the V-6 engine. Residual fuel is finally carried back to a fuel tank. Around the rail tubes 4*b* and 4*d*, rigid brackets 12 are clamped so as to mount the assembly 10 on the engine. Alternatively, rigid brackets 13 may be welded to outer surfaces of the sockets.

Figure 2:
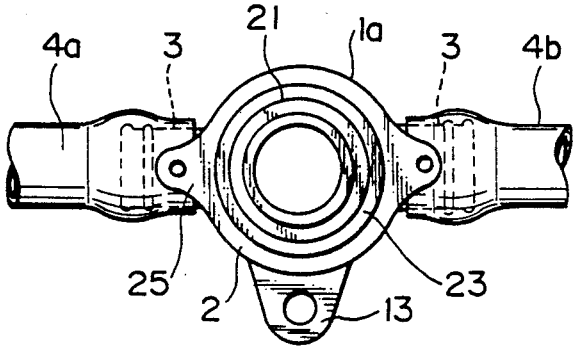
FIG. 2 is a top plan view illustrating a connecting relationship between a socket and adjacent rail tubes.
Figure 3:
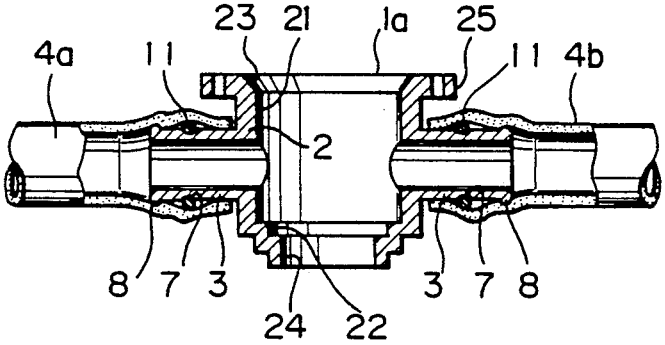
FIG. 3 is a vertical sectional view illustrating an internal connecting relationship of the portion in FIG. 2.

FIGS. 2 and 3 illustrate connecting relationships between the socket 1*a* and adjacent rail tubes 4*a* and 4*b*. As typically shown in these figures, each socket comprises a tubular body 2 and a pair of extension pipes 3 extending outwardly from the body toward opposite directions. The interior surfaces 21, 22, 23 and 24 of the tubular body 2 are so formed as to receive a body of a fuel injector. The socket 1*a* is made by metallic materials through a forging process and welding process, or integrally made through aluminum die casting process. Alternatively, the socket may be integrally made from hard plastics such as polyether imide (PEI) resin or polyamide (PA) resin having superior properties of heat-resistance and fuel-resistance, through an injection moulding process. Then, the interior surfaces are finished to obtain a required surface smoothness.

The inlet flange 5 is also provided with an extension pipe 15 similar to the extension pipe 3. On outer periphery of each of the extension pipes 3 and 15, an O-ring groove 7 and an outward protrusion 8 are provided.

In FIG. 3, after an O-ring 11 is set into the groove 7, each end portion of the rail tubes 4*a* and 4*b* is mechanically enlarged and pushed over the extension pipe into overlapping relation to the extension pipe. When the every rail tubes 4*a*, 4*b*, 4*c* and 4*d* are set in the predetermined overlapped positions as shown in FIG. 1, a provisional assembly is obtained. Then, the assembly is set on a jig tool in order to locate the sockets 1*a*, 1*b* and 1*c* at a predetermined distance from each other. At the same time, angular orientations of the inlet flange 5 and the joint pipe 6 are adjusted on the jig tool.

Under the condition that the provisional assembly is set on the jig tool, the rail tubes 4*a*, 4*b*, 4*c* and 4*d* are exposed to heat by means of electrical heating elements or heated air until it reaches to a predetermined temperature. Since the rail tubes are made from heat shrinkable plastics, they are tightly fixed on the extension pipes. The brackets 12 are preferably clamped on the rail tubes after the heating process. Thus, the every extension pipes and the rail tubes are overlapped and combined in fluid tight communication together with the intermediate O-rings 11 and protrusions 8. Any other seal members such as seal rings or gaskets can be substituted for the O-rings 11.

Figure 4:
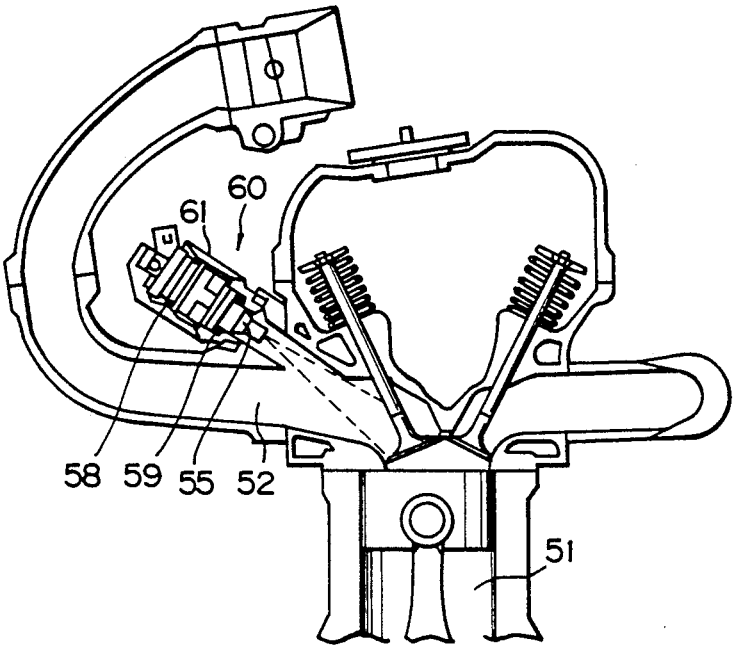
FIG. 4 is a schematic sectional view of a fuel injection type engine, illustrating a mounting relationship between the fuel delivery rail assembly, injector and intake manifold.
Figure 5:
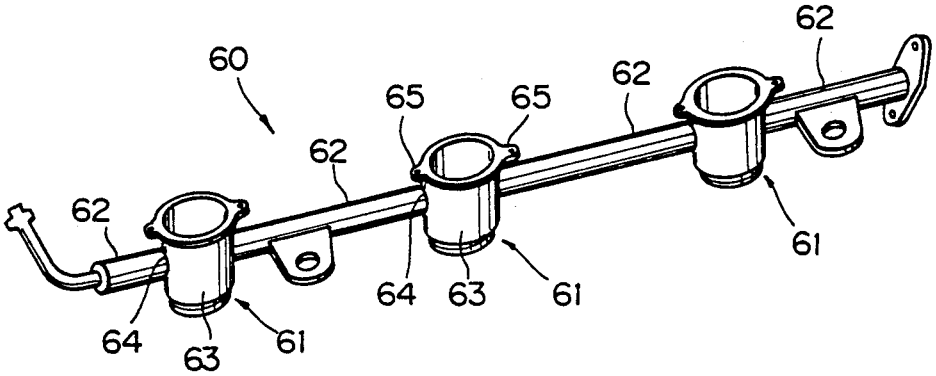
Fig. 5 PRIOR ART
FIG. 5 is a perspective view of the conventional fuel delivery rail assembly in FIG. 4.

In FIG. 3, inside of the socket 1*a*, are provided smooth interior surfaces 21 and 22 for receiving a body of the injector 55 having O-rings 58 and 59 thereon, a conical cut end surface 23 at the top opening, and a stepped bottom opening surface 24. On upper flange of the tubular body 12 of the socket 1*a*, a pair of extensions 25 having threaded holes are provided so as to receive the cap (see FIG. 4) after accommodating the injector 55 therein.

If the sockets are made from plastic materials, it is most preferable to make the plastic sockets from a glass-fiber reinforced polyamide resin and to apply nickel coatings to the surfaces thereof. As a result of the specially prepared plastic materials and the nickel coatings, the sockets can resist against high temperature of the engine and also against an exposure to gasoline fuel.

Thus, as is apparent from the above description, the fuel delivery rail assembly of the present invention can provide technical advantages as follows:

(a) Since many kinds of working and transferring steps can be saved, manufacturing process is considerably simplified.

(b) Since there remains a flexibility for the axial direction of the socket due to the resiliency of the plastic rail tubes, it becomes possible to make a practical adjustment between the socket and the injector.

(c) Since a portion of the assembly is interchanged into a plastic part, the weight of the assembly is reduced, whereby a resultant weight of the engine becomes smaller.

(d) Since the plastic rail tubes can help to damp a vibration of the assembly, generation of noise is effectively reduced.

I claim:

1. A fuel delivery rail assembly for an internal combustion engine comprising;

a plurality of sockets, and a plurality of rail tubes made from heat shrinkable plastic materials extending from said sockets, each of said sockets having a tubular body and a pair of extension pipes extending outwardly from the body toward opposite directions, interior surfaces of said tubular body being so formed as to receive a fuel injector, at least one end of each rail tube being overlapped above said extension pipe with a seal member therebetween, each overlapped portion of said rail tubes being fixed on the extension pipe after being heated to a predetermined temperature.

2. A fuel delivery rail assembly as claimed in claim 1, wherein said heat shrinkable plastic materials comprise crosslinked polyolefin plastics having heat resistant properties.

* * * * *